US010704839B2

(12) United States Patent
Hoang

(10) Patent No.: US 10,704,839 B2
(45) Date of Patent: Jul. 7, 2020

(54) TEMPERATURE ACTUATED CAPILLARY VALVE FOR LOOP HEAT PIPE SYSTEM

(71) Applicant: The Government of the United States of America, as represented by the Secretary of the Navy, Arlington, VA (US)

(72) Inventor: Triem T. Hoang, Clifton, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 161 days.

(21) Appl. No.: 16/042,663

(22) Filed: Jul. 23, 2018

(65) Prior Publication Data

US 2018/0340739 A1 Nov. 29, 2018

Related U.S. Application Data

(62) Division of application No. 14/822,612, filed on Aug. 10, 2015, now Pat. No. 10,030,914, which is a division of application No. 13/570,823, filed on Aug. 9, 2012, now Pat. No. 9,146,059.

(60) Provisional application No. 61/647,593, filed on May 16, 2012.

(51) Int. Cl.
*F28D 15/04* (2006.01)
*F28D 15/06* (2006.01)

(52) U.S. Cl.
CPC ..... *F28D 15/043* (2013.01); *F28D 15/06* (2013.01)

(58) Field of Classification Search
CPC ..... F28D 15/043; F28D 15/06; F28D 15/0266
USPC ..... 165/274
See application file for complete search history.

(56) References Cited

U.S. PATENT DOCUMENTS 3,543,839 A * 12/1970 Shlosinger ..... B64G 6/00 165/274
7,013,956 B2 * 3/2006 Thayer ..... F25B 23/006 165/104.25
2002/0195242 A1 * 12/2002 Garner ..... F28D 15/043 165/274
2009/0314472 A1 * 12/2009 Kim ..... F28D 15/043 165/104.26
2010/0221627 A1 * 9/2010 Nakakubo ..... F28D 15/0266 429/434

* cited by examiner

*Primary Examiner* — Jon T. Schermerhorn, Jr.
(74) *Attorney, Agent, or Firm* — US Naval Research Laboratory; Richard Bis

(57) ABSTRACT

A two-phase heat transfer system including at least one two-phase evaporator, at least one condenser, a vapor conduit joining a vapor outlet of the two-phase evaporator to an inlet of the condenser, a liquid conduit joining an outlet of the condenser to a liquid inlet of the two-phase evaporator, and a thermally-actuated capillary flow valve. The thermally-actuated capillary flow valve having a valve inlet, a valve outlet, a thermal connection to a heat sink for cold biasing the capillary flow valve, a porous wick extending across the flow passageway of the capillary flow valve, and a heater thermally connected to the capillary flow valve, where actuation of the heater evaporates liquid in the porous wick to allow passage of vapor through the capillary flow valve.

14 Claims, 4 Drawing Sheets

TEMPERATURE ACTUATED CAPILLARY VALVE FOR LOOP HEAT PIPE SYSTEM

CROSS-REFERENCE TO RELATED APPLICATIONS

This application is a divisional application of Ser. No. 14/822,612, which is a divisional of U.S. Pat. No. 9,146,059, which is a non-provisional application under 35 USC 119(e) of, and claims the benefit of, provisional patent application 61/647,593, filed in the United States on May 16, 2012.

BACKGROUND

1. Technical Field

This is related to heat transfer devices, and more particularly, to loop heat pipe systems suitable for aerospace use.

2. Description of Related Technology

Two-phase heat transfer systems known as capillary heat pipes and loop heat pipes were first developed in the 1980s. U.S. Pat. No. 4,515,209 to Maidanik et al. describes the first known loop heat pipe, developed in the former Soviet Union in the early 1980s.

The operating temperature of a two-phase heat transfer system is typically governed by the saturation temperature of its compensation chamber. One approach to thermal control has involved cold-biasing the compensating chamber and using an electric heater to maintain the set-point temperature.

For most of the system operational envelope of a typical space-based loop heat pipe system, the heater power is less than about one percent of the total heat transport. However, the heater power increase significantly, e.g., to about 15 to 20%, when the heat sink becomes too hot. For example, in a space environment, a satellite can have a condenser at or near the surface of the satellite. When the side of the satellite having the condenser faces away from the sun, the area is very cold, and the condenser is able to operate effectively. When the side of the satellite having the condenser is facing toward the sun, the heat sink becomes too hot.

J. Ku and H. Nagano, "Loop Heat Pipe Operation with Thermoelectric Converters and Coupling Blocks", AIAA Paper No. AIAA-2007-4713, pp. 1-14, (2001), and in J. Ku, L. Ottenstein, D. Douglas, Paulken, M., and Birur, G., "Multi-Evaporator Miniature Loop Heat Pipe for Small Spacecraft Thermal Control", Government Microcircuit Applications and Critical Technology Conference, Las Vegas, Nev., Apr. 4-7, 2005 discuss some approaches for thermal control.

BRIEF SUMMARY

A temperature-actuated capillary flow valve for use in a two phase heat transfer system, the valve including an inlet port for receiving working fluid in a vapor-phase, an outlet port, and a housing extending between the inlet port and the outlet port, the housing defining a flow passage, with a porous wick material extending across the flow passage, the housing configured to be heated by a heat source to evaporate liquid-phase working fluid from the wick and allow the vapor-phase working fluid to pass through the wick to the outlet port, wherein removal of the heat source allows liquid to condense in the wick, thereby preventing flow of the vapor-phase working fluid through the wick to the outlet port.

The flow valve can be cooled by a thermal strap configured to transfer heat from the valve housing to a heat sink. The thermal strap and the heat source can be positioned on the housing, with the thermal strap closer to the outlet port and the heat source closer to the inlet port. The wick can be a sintered porous metal. The working fluid can be ammonia. The heat source can be an electrical resistance heating element adhered to the valve housing.

An aspect is directed to the temperature-activated capillary flow valve in fluid combination with a two-phase capillary pump and with a condenser in a loop heat pipe system.

The exterior surface of the wick can be smooth, with a close fit to the interior surface of the housing. The exterior surface of the wick can have at least one longitudinal groove extending the length of the wick.

An aspect is directed to a two-phase heat transfer system comprising at least one two-phase loop heat pipe capillary pump; at least one condenser; a vapor conduit joining the outlet of the capillary pump to the inlet of the condenser; a liquid conduit joining the outlet of the condenser to the inlet of the capillary pump; and a thermally-actuated capillary flow valve having an inlet, an outlet, a thermal connection to a heat sink for cold biasing the capillary valve, a porous wick extending across the flow passageway of the flow valve, and a heater thermally connected to the capillary flow valve, wherein actuation of the heater evaporates liquid in the wick, thereby allowing passage of vapor through the capillary flow valve.

An aspect is directed to a two-phase heat transfer system comprising: at least one two-phase loop heat pipe capillary pump; a plurality of condensers, each condenser having a thermal connection to a cold sink at an external face of the spacecraft; a vapor conduit joining the outlet of the capillary pump to the inlets of the condensers; a liquid conduit joining the outlets of the condensers to the inlet of the capillary pump; and a plurality of thermally-actuated capillary flow valves, each arranged in the vapor line at an inlet of each condenser, each thermally-actuated capillary flow valve having an inlet, an outlet, a thermal connection to a heat sink for cold biasing the capillary valve, a porous wick extending across the flow passageway of the flow valve, and a heater thermally connected to the capillary flow valve, wherein actuation of the heater evaporates liquid in the wick, thereby allowing passage of vapor through the capillary flow valve to the condenser.

BRIEF DESCRIPTION

FIG. 1 is a schematic view of a two phase heat transfer system having a capillary valve in accordance with an embodiment of the invention.

FIGS. 2A, 2B, and 2C illustrate operation of a capillary valve in accordance with an embodiment of the invention when in an "off" position.

DETAILED DESCRIPTION

Figure 1:
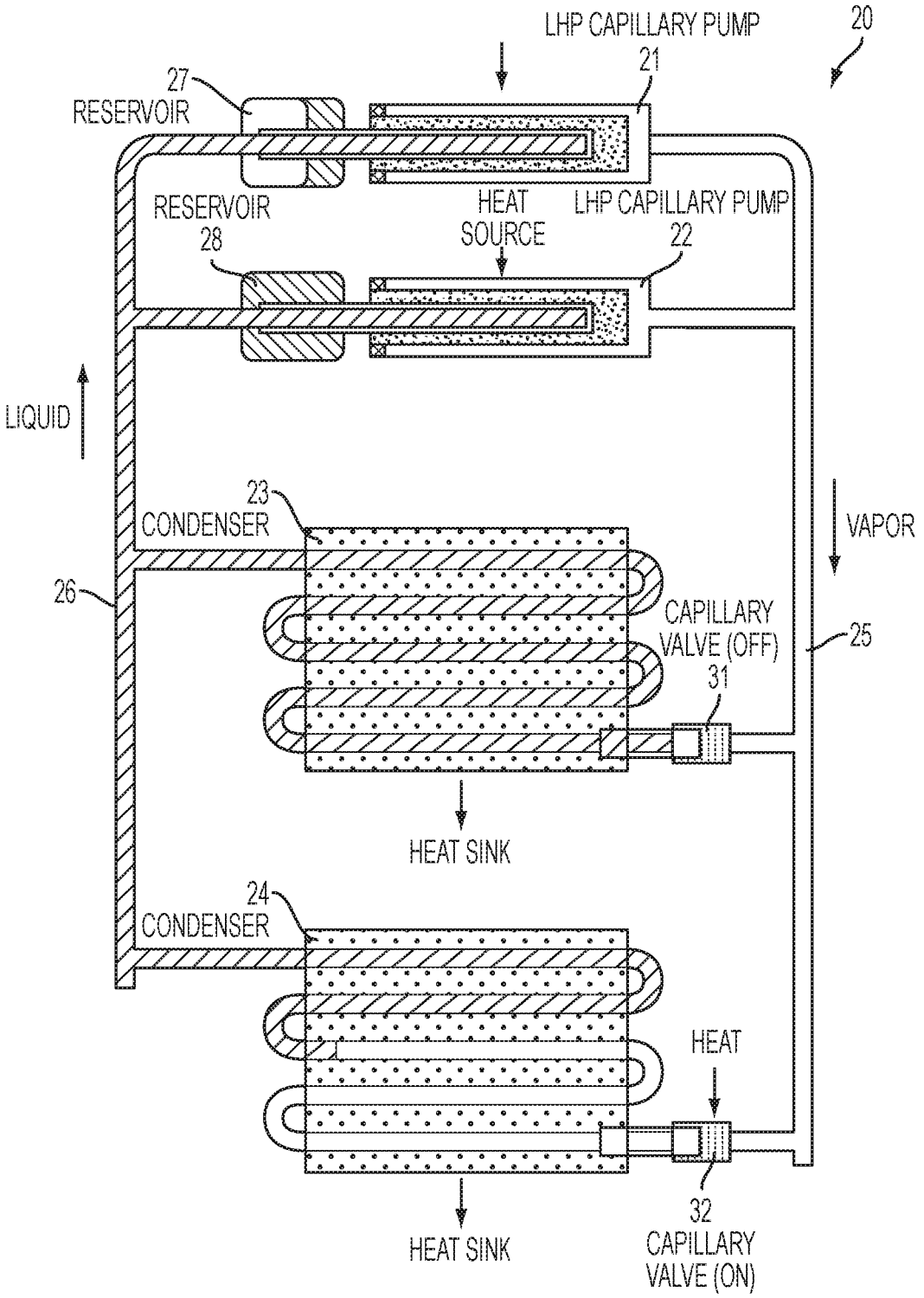

FIG. 1 illustrates a two-phase heat transfer system 20 in accordance with an embodiment of the invention. The loop heat pipe system 20 operates based on the condensation and evaporation of a working fluid to transfer heat, and on the capillary forces in the wicks of the capillary pumps to circulate the working fluid.

The two-phase heat transfer system 20 has a vapor conduit 25, a liquid conduit 26, at least one capillary pump or evaporator and at least one condenser. In this example, the system has two capillary pumps or evaporators 21 and 22, and two condensers 23 and 24.

Each of the capillary pumps 21, 22 can have an associated reservoir or compensation chamber 27, 28 for holding liquid working fluid. The reservoir 27, 28 can be external to the capillary pump 21, 22, as shown in FIG. 1. The capillary pumps 21, 22 are positioned at the heat sources for removing heat from the heat source. The heat source can be, for example, electronic devices onboard a spacecraft. The capillary pump absorbs heat from the heat source and warms the working fluid in the capillary pump, with the working fluid vapor exiting from the outlet of the capillary pump to the vapor conduit 25. A typical heat-pipe capillary pump has a wick structure that is saturated with the working fluid. The wick structure develops the capillary action for the liquid working fluid. Because the heat pipe operates at a vacuum, the working fluid in the capillary pump boils and takes up latent heat from the heat sink at well below its boiling point at atmospheric pressure.

The condensers 23, 24 are preferably located at cold points of the system 10 to effectively cool and condense the working fluid. In a spacecraft application, a heat sink such as a radiator extending from the condenser to the exterior of the spacecraft can cool the condenser.

Flow through each condenser is controlled by a capillary valve. The capillary valve allows or stops the flow of the working fluid to the condenser. For example, when the radiator that cools a particular condenser has too high a temperature to sufficiently cool the working fluid, it is desired to turn off that condenser.

In a spacecraft environment, when a spacecraft changes orientation, one surface of the spacecraft can go from being shaded and cool to sunny and warm. The capability to individually stop or start the flow of working fluid through each condenser allows the system compensate for these changes in solar load by directing the working fluid to only those condensers that can effectively cool the working fluid.

Each of the condensers has a capillary valve arranged in the vapor conduit 25 upstream of the condenser. In FIG. 1, the capillary valve 31 is located at the input of the condenser 23 and a second capillary valve 32 is arranged at the input of the other condenser 24.

In systems with more than two condensers, each condenser will have an associated capillary valve, or alternatively, a capillary valve can control more than one condenser. The capillary valve can positioned at other points in the vapor conduit 25. However, in many systems in which crowded racks of electronics are the heat source, there can be insufficient space to position the capillary valves in the vapor conduits near the capillary pumps.

Figure 2A:
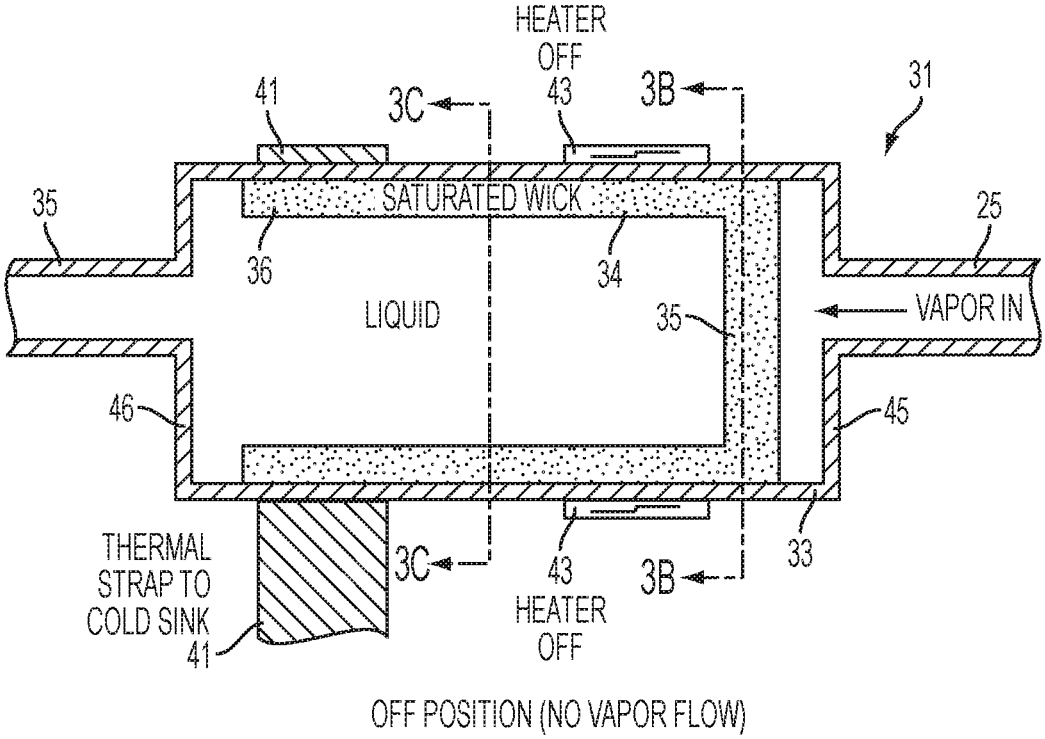
FIGS. 2D and 2E illustrate operation of a capillary valve in accordance with an embodiment of the invention when in an "on" position.
Figure 2B:
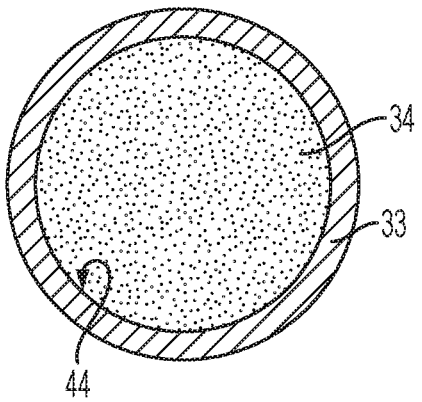
Figure 2C:
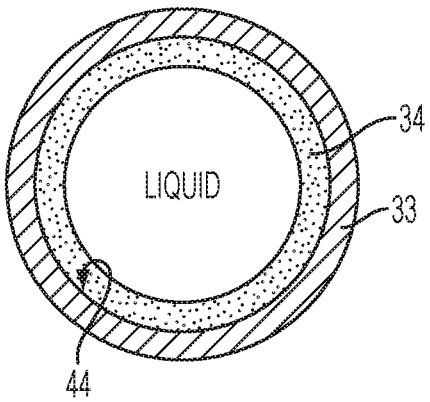
Figure 2D:
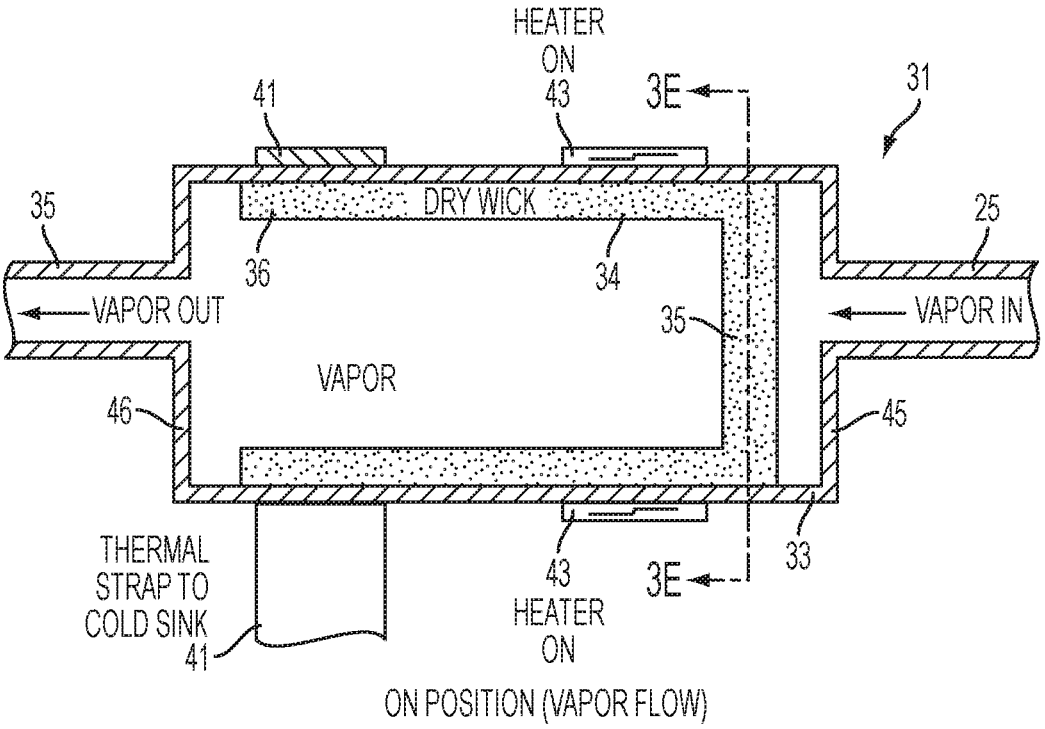
Figure 2E:
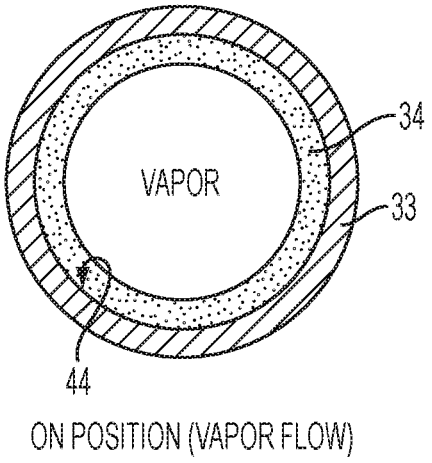

FIG. 2A, 2B, 2C are cross sectional views illustrating operation of a capillary valve 31 in accordance with an embodiment of the invention, with the capillary valve in the off position, in which no working fluid flows through the valve. FIGS. 2D and 2E illustrate the same valve in an "off"

The capillary valve has a housing 33 that extends from the vapor inlet 45 at the vapor conduit 25 to the capillary valve outlet 46. Near the input end of the capillary valve 31, the wick 34 extends across the entire flow path inside the housing.

One or more heat sources are positioned near the vapor input end of the capillary valve. The heater can be an electrical resistance heater. For example, electrical resistance heating elements 43 can be adhered to the outer surface of the capillary valve housing with polyimide tape or another suitable surface connector.

A cold source, for example, a thermal strap 41 connected to a cold sink, is positioned near the capillary valve outlet 46. This thermal strap, or other cold source, cools the capillary valve housing and biases the valve toward condensing the vapor in the wick when the heating elements 43 are not activated.

By applying or not applying heat at the heater, the capillary valve 31 can be activated to an "on" position in which vapor passes through the capillary valve to the condenser, or activated to an "off" position in which no vapor passes through the capillary valve to the condenser.

The wick 34 is a porous structure with pores sized to allow a particular rate of fluid flow. The wick can be porous plastic, porous metal, or another material. Metal wicks can be formed by sintering metal particles to achieve a pore size in the desired range. Wicks can also be formed of screen material or material with grooves extending through the wick to induce condensation.

The wick 34 has an outer surface in close contact with the interior surface 44 of the housing 33 so no liquid or vapor can bypass the outside of the wick 34. If the wick is porous metal and the housing is metal, the seal can be formed by welding one end of the wick to the inner surface of the housing. If the wick is porous plastic, the seal can be formed by press fitting the wick into the housing or with an adhesive.

In this embodiment, the wick 34 has a first end 35 that is near the vapor inlet 45 of the capillary valve and a second end 36 that is closer to the capillary valve outlet 46. The wick's first end portion 35 extends completely across the capillary valve's interior cross section as shown in FIGS. 2A and 2B. The wick's second end portion 36 has a hollow sleeve shape, as shown in FIGS. 2A and 2C. In other embodiments, the wick 34 can have a uniform cross section extending across the interior of the housing without any sleeve portion. The interior wall of the capillary valve housing can be of any cross sectional profile, such as round, square, rectangular, etc. In a preferred embodiment, the housing is cylindrical, and the outer surface of the wick has a cylindrical shape that extends along most of the length of the housing, to provide good conductive heat transfer between the housing and the wick.

As seen in FIGS. 2A, 2B, and 2C, when the capillary valve 31 is "off", with no heat applied at the heating elements, the capillary valve housing is cooled by the thermal strap 41 to the cold sink, and the cool housing condenses the working fluid within the capillary valve. The resulting liquid in the wick structure does not allow vapor to flow through the valve.

FIGS. 2D and 2E illustrate the valve 31 when activated to an "on" position by applying heat at the heating elements 43. The working fluid is not condensed, so the vapor entering the capillary valve inlet 25 can pass through the wick to the outlet port 35 of the capillary valve 31.

The working fluid can be any type of suitable two-phase coolant, such as ammonia, water, ethanol, ethane, acetone, sodium, propylene, mercury, liquid helium, indium, nitrogen, methanol, or ethanol, depending on the specific application and the desired operational temperature range.

The capillary valve housing materials and wick material are formed of materials that are compatible with the working fluid and suitable for the operating environment. For a spacecraft application, the capillary valve can be formed of aerospace-qualified material that is not corroded by the working fluid. For example, for an ammonia working fluid, stainless steel or aluminum can form the housing, and the wick can be stainless steel, aluminum, or plastic. The capillary valve can also be formed of copper, titanium, or another material.

In the example embodiment described above, the reservoirs are external to the capillary pumps or evaporators. It is also suitable that the capillary valves described herein can be used in capillary-pumped loop systems in which the reservoirs are integral to the evaporators.

Figure 3A:
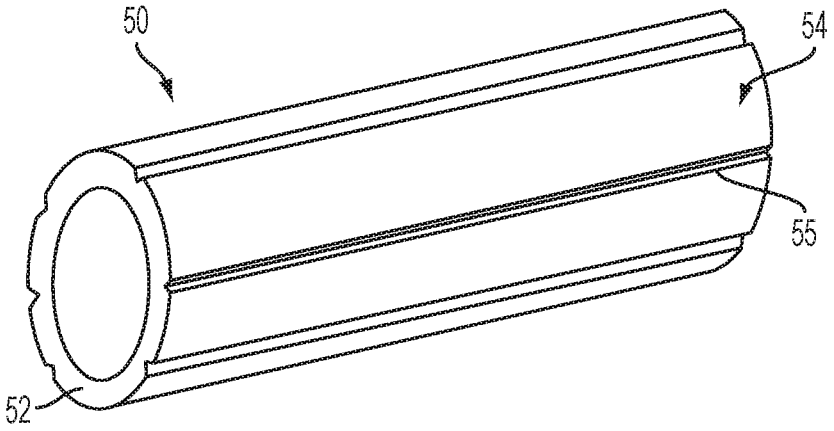
FIGS. 3A and 3B illustrate a wick structure for use in a capillary valve in accordance with an embodiment of the invention.
Figure 3B:
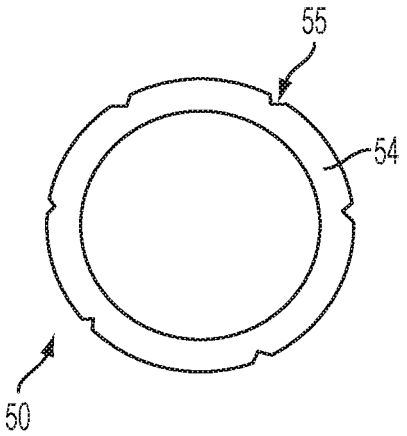

FIGS. 3A and 3B illustrate a wick structure in accordance with another embodiment of the invention. FIG. 3A is a perspective view of the wick 50, and FIG. 3B is a view taken from the outlet end 52 of the wick 50. In this embodiment, the wick 50 has several longitudinal grooves 55 in the exterior cylindrical surface 54 of the wick that extend the length of the wick. The grooves 55 allow a small amount of vapor to bypass the wick. This is believed to reduce the chance that vapor lock will occur.

Embodiments of the invention are also directed to two phase heat transfer systems having at least one heat exchanger or capillary pump, at least one condenser, vapor lines joining the outlet of the capillary pump and the input of the condenser, a liquid line joining the outlet of the condenser and the inlet of the capillary pump, and a thermally actuated capillary valve described above located in the vapor line to control flow to the condenser.

The system can be a two-phase heat transfer system onboard a spacecraft, and has several condensers with heat sinks located at different exterior faces of the spacecraft. Each condenser has an associated thermally actuated capillary flow valve. When the spacecraft turns one of the faces toward the sun, a controller shuts off the heater to the capillary valve for the affected condenser, shutting off flow to that condenser and allowing the other, cooler condensers to condense the working fluid. The system also allows remote activation and deactivation of any or all of the capillary valves by an earth-based controller if circumstances indicate.

The capillary valves described herein are not limited to use with loop heat pipe systems or capillary heat pipe systems, but can be used in any two-phase heat transfer system having a cold sink sufficiently cool to cause condensation in the capillary valve wick and an available heater for activating the capillary flow valve by evaporation of the liquid in the wick.

The system described and shown above has several advantages over previously used flow control systems for two-phase heat transfer systems.

One advantage of the thermally-controlled capillary valves described herein is that the system does not require mechanical valves to control the flow at the input or the outlet of the condenser. The capillary valves have no moving parts, and are simple to activate and deactivate with an electrical resistance heater.

In addition, an electronic controller can monitor the temperature of the liquid leaving the condensers, and deactivate the electrical resistance heater at the capillary valve if needed to turn off the flow to a particular condenser. When the system is designed properly for its environment, the required heater power is expected to be less than 1% of the total heat transport, regardless of the sink temperature.

Activation and de-activation of the capillary valve can also be carried out on-command, whenever needed. Thus, unexpected scenarios can be rectified real-time.

Further, when the capillary valve is not activated, the capillary valve has no effect on the system, and is transparent to the loop performance.

The invention has been described with reference to certain preferred embodiments. It will be understood, however, that the invention is not limited to the preferred embodiments discussed above, and that modification and variations are possible within the scope of the appended claims.

What is claimed as new and desired to be protected by Letters Patent of the United States is:

1. A two-phase heat transfer system comprising:
at least one two-phase evaporator;
at least one condenser;
a vapor conduit joining a vapor outlet of the two-phase evaporator to an inlet of the condenser;
a liquid conduit joining an outlet of the condenser to a liquid inlet of the two-phase evaporator; and
the thermally-actuated capillary flow valve having a valve inlet, a valve outlet, a thermal connection to a heat sink for cold biasing the capillary flow valve, a porous wick extending across the flow passageway of the capillary flow valve, and a heater thermally connected to the capillary flow valve, wherein actuation of the heater evaporates liquid in the porous wick, thereby allowing passage of vapor through the capillary flow valve.

2. The two-phase heat transfer system of claim 1, wherein the thermal connection is a thermal strap configured to cool the capillary flow valve by transferring heat from the capillary flow valve to the heat sink.

3. The two-phase heat transfer system of claim 2, wherein the heater is an electrical resistance heating element adhered to a housing of the capillary flow valve at a location between the valve outlet and the thermal strap, and the thermal strap is located between the valve inlet and the heater.

4. The two-phase heat transfer system of claim 2, wherein the heater is an electrical resistance heating element adhered to a housing of the capillary flow valve.

5. The two-phase heat transfer system of claim 1, wherein the porous wick is of a sintered porous metal.

6. The two-phase heat transfer system of claim 1, wherein an exterior surface of the porous wick is smooth, with a close fit to an interior surface of a housing of the capillary flow valve.

7. The two-phase heat transfer system of claim 1, wherein an exterior surface of the porous wick has at least one longitudinal groove extending a length of the porous wick.

8. A two-phase heat transfer system comprising:
at least one two-phase evaporator;
a plurality of condensers, each condenser having a first thermal connection to a cold sink;
a vapor conduit joining a vapor outlet of the two-phase evaporator to inlets of the condensers;
a liquid conduit joining outlets of the condensers to a liquid inlet of the two-phase evaporator; and
a plurality of thermally-actuated capillary flow valves, each arranged in the vapor conduit at the inlet of each condenser,
each thermally-actuated capillary flow valve having a valve inlet, a valve outlet, a second thermal connection to a heat sink for cold biasing the capillary flow valve, a porous wick extending across the flow passageway of the capillary flow valve, and a heater thermally connected to the capillary flow valve, wherein actuation of the heater evaporates liquid in the porous wick, thereby allowing passage of vapor through the capillary flow valve.

9. The two-phase heat transfer system of claim 8, wherein the second thermal connection is a thermal strap configured to cool the capillary flow valve by transferring heat from the capillary flow valve to the heat sink.

10. The two-phase heat transfer system of claim 9, wherein the heater is an electrical resistance heating element adhered to a housing of the capillary flow valve at a location between the valve outlet and the thermal strap, and the thermal strap is located between the valve inlet and the heater.

11. The two-phase heat transfer system of claim 9, wherein the heater is an electrical resistance heating element adhered to a housing of the capillary flow valve.

12. The two-phase heat transfer system of claim 8, wherein the porous wick is of a sintered porous metal.

13. The two-phase heat transfer system of claim 8, wherein an exterior surface of the porous wick is smooth, with a close fit to an interior surface of a housing of the capillary flow valve.

14. The two-phase heat transfer system of claim 8, wherein an exterior surface of the porous wick has at least one longitudinal groove extending a length of the porous wick.

* * * * *